US010323536B2

(12) United States Patent
Hill

(10) Patent No.: US 10,323,536 B2
(45) Date of Patent: Jun. 18, 2019

(54) ACTIVE CLEARANCE CONTROL FOR AXIAL ROTOR SYSTEMS

(71) Applicant: United Technologies Corporation, Hartford, CT (US)

(72) Inventor: James D. Hill, Tolland, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 1086 days.

(21) Appl. No.: 14/682,653

(22) Filed: Apr. 9, 2015

(65) Prior Publication Data

US 2016/0298483 A1 Oct. 13, 2016

(51) Int. Cl.

| | |
|---|---|
| ***F01D 11/22*** | (2006.01) |
| ***F04D 29/64*** | (2006.01) |
| ***F04D 29/16*** | (2006.01) |
| ***F01D 9/04*** | (2006.01) |
| ***F04D 29/32*** | (2006.01) |

(52) U.S. Cl.

CPC ..... *F01D 11/22* (2013.01); *F01D 9/041* (2013.01); *F04D 29/164* (2013.01); *F04D 29/324* (2013.01); *F04D 29/642* (2013.01); *F05D 2220/32* (2013.01); *F05D 2240/12* (2013.01); *F05D 2260/57* (2013.01)

(58) Field of Classification Search

CPC ..... F01D 11/22; F01D 11/20; F01D 11/08; F04D 29/642

See application file for complete search history.

(56) References Cited

U.S. PATENT DOCUMENTS

| | | | | |
|---|---|---|---|---|
| 7,341,426 | B2 * | 3/2008 | Schwarz | F01D 11/122 415/127 |
| 7,824,151 | B2 | 11/2010 | Schwarz et al. | |
| 2006/0140755 | A1 | 6/2006 | Schwarz et al. | |
| 2008/0063513 | A1 * | 3/2008 | Afanasiev | F01D 11/22 415/138 |
| 2011/0076137 | A1 * | 3/2011 | Bolgar | F01D 11/22 415/134 |
| 2013/0315716 | A1 * | 11/2013 | Cotroneo | F01D 11/22 415/130 |

FOREIGN PATENT DOCUMENTS

| | | | |
|---|---|---|---|
| EP | 1249577 | 10/2002 | |
| EP | 2233701 | 9/2010 | |
| EP | 2233701 A1 * | 9/2010 | F01D 11/22 |
| FR | 2943093 | 9/2010 | |

OTHER PUBLICATIONS

Extended European Search Report dated Aug. 19, 2016 in European Application No. 16164688.0.

* cited by examiner

*Primary Examiner* — Richard A Edgar
*Assistant Examiner* — Michael L Sehn
(74) *Attorney, Agent, or Firm* — Snell & Wilmer, L.L.P.

(57) ABSTRACT

A system includes a stator assembly including at least one stator airfoil. The system also includes a rotor assembly including at least one rotor airfoil configured to rotate about an axis. The system also includes an actuator coupled to the stator assembly and configured to actuate the stator assembly in an axial direction relative to the rotor assembly, creating an axial movement such that a clearance between the at least one rotor airfoil and the stator assembly varies based on an axial position of the stator assembly.

14 Claims, 4 Drawing Sheets

ACTIVE CLEARANCE CONTROL FOR AXIAL ROTOR SYSTEMS

FIELD

The present disclosure relates generally to axial rotor systems of a gas turbine engine and, more particularly, to a stator assembly capable of moving forward and aft relative to a rotor assembly.

BACKGROUND

Gas turbine engines typically include compressors having multiple rows, or stages, of rotating blades and multiple stages of stators. The rotating blades rotate about an axis while the stators are fixed such that they do not rotate about the axis. A gap can exist between an outer diameter edge of the rotors and an outer diameter edge of the stators. The size of this gap affects the efficiency of the compressor as the smaller the gap is, the less the pressure loss occurs. However, elimination of this gap would be detrimental because the compressor is occasionally subjected to external forces, such as aerodynamic maneuvers, unbalanced loads of the rotors, thermal expansion of the rotors or the stators or the like.

SUMMARY

What is described is a system for increasing efficiency of a gas turbine engine. The system includes a stator assembly including at least one stator airfoil. The system also includes a rotor assembly including at least one rotor airfoil configured to rotate about an axis. The system also includes an actuator coupled to the stator assembly and configured to actuate the stator assembly in an axial direction relative to the rotor assembly, creating an axial movement such that a clearance between the at least one rotor airfoil and the stator assembly varies based on an axial position of the stator assembly.

Also described is a system for increasing efficiency of a compressor section of a gas turbine engine. The system includes a rotor assembly including a rotor outer diameter edge, and at least one rotor airfoil configured to rotate about an axis and to compress a fluid. The system also includes a stator assembly including a stator outer diameter edge, and a stator airfoil configured to condition the fluid, such that the rotor outer diameter edge and the stator outer diameter edge define a conic shape. The system also includes an actuator coupled to the stator assembly and configured to actuate the stator assembly in an axial direction relative to the rotor assembly, creating an axial movement such that a clearance between the at least one rotor airfoil and the stator assembly varies based on an axial position of the stator assembly.

Also described is a method for increasing efficiency of a compressor. The method includes receiving, by a controller, an input indicating an amount of force to be applied to the compressor. The method also includes determining, by the controller, a determined direction and a determined amount to move a stator assembly in an axial direction relative to a rotor assembly based on the input. The method also includes instructing, by the controller, an actuator coupled to the stator assembly to actuate the stator assembly the determined amount in the determined direction.

BRIEF DESCRIPTION OF THE DRAWINGS

The subject matter of the present disclosure is particularly pointed out and distinctly claimed in the concluding portion of the specification. A more complete understanding of the present disclosure, however, is best be obtained by referring to the detailed description and claims when considered in connection with the drawing figures, wherein like numerals denote like elements.

DETAILED DESCRIPTION

Figure 1:
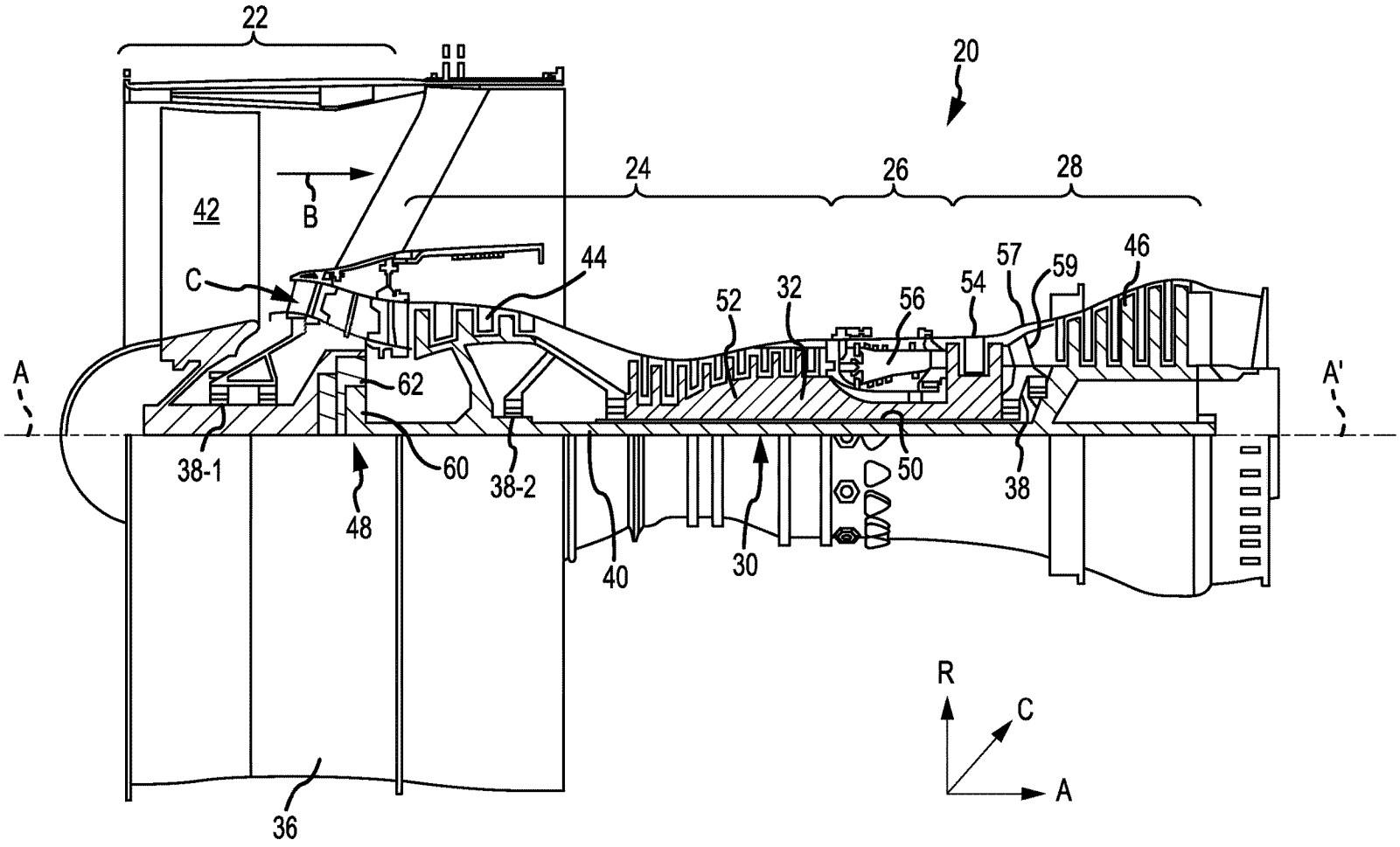
FIG. 1 illustrates cross-sectional view of an exemplary gas turbine engine, in accordance with various embodiments.

With reference to FIG. 1, a gas turbine engine 20 is provided. An A-R-C axis illustrated in each of the figures illustrates the axial (A), radial (R) and circumferential (C) directions. As used herein, "aft" refers to the direction associated with the tail (e.g., the back end) of an aircraft, or generally, to the direction of exhaust of the gas turbine engine. As used herein, "forward" refers to the direction associated with the nose (e.g., the front end) of an aircraft, or generally, to the direction of flight or motion. As utilized herein, radially inward refers to the negative R direction and radially outward refers to the R direction.

Gas turbine engine 20 can be a two-spool turbofan that generally incorporates a fan section 22, a compressor section 24, a combustor section 26 and a turbine section 28. Alternative engines include an augmentor section among other systems or features. In operation, fan section 22 drives coolant along a bypass flow-path B while compressor section 24 drives coolant along a core flow-path C for compression and communication into combustor section 26 then expansion through turbine section 28. Although depicted as a turbofan gas turbine engine 20 herein, it should be understood that the concepts described herein are not limited to use with turbofans as the teachings can be applied to other types of turbine engines including three-spool architectures.

Gas turbine engine 20 generally comprise a low speed spool 30 and a high speed spool 32 mounted for rotation about an engine central longitudinal axis A-A' relative to an engine static structure 36 via several bearing systems 38, 38-1, and 38-2. It should be understood that various bearing systems 38 at various locations can alternatively or additionally be provided, including for example, bearing system 38, bearing system 38-1, and bearing system 38-2.

Low speed spool 30 generally includes an inner shaft 40 that interconnects a fan 42, a low pressure (or first) compressor section 44 and a low pressure (or first) turbine section 46 inner shaft 40 is connected to fan 42 through a geared architecture 48 that can drive fan 42 at a lower speed than low speed spool 30. Geared architecture 48 includes a gear assembly 60 enclosed within a gear housing 62. Gear assembly 60 couples inner shaft 40 to a rotating fan structure. High speed spool 32 includes an outer shaft 50 that interconnects a high pressure (or second) compressor section 52 and high pressure (or second) turbine section 54. A combustor 56 is located between high pressure compressor 52 and high pressure turbine 54. A mid-turbine frame 57 of engine static structure 36 is located generally between high pressure turbine 54 and low pressure turbine 46. Mid-turbine frame 57 supports one or more bearing systems 38 in turbine section 28. Inner shaft 40 and outer shaft 50 are concentric and rotate via bearing systems 38 about the engine central longitudinal axis A-A', which is collinear with their longitudinal axes. As used herein, a "high pressure" compressor or turbine experiences a higher pressure than a corresponding "low pressure" compressor or turbine.

The core airflow C is compressed by low pressure compressor section 44 then high pressure compressor 52, mixed and burned with fuel in combustor 56, then expanded over high pressure turbine 54 and low pressure turbine 46. Mid-turbine frame 57 includes airfoils 59 which are in the core airflow path. Turbines 46, 54 rotationally drive the respective low speed spool 30 and high speed spool 32 in response to the expansion.

Gas turbine engine 20 is a high-bypass geared aircraft engine. The bypass ratio of gas turbine engine 20 can be greater than about six (6). The bypass ratio of gas turbine engine 20 can also be greater than ten (10). Geared architecture 48 can be an epicyclic gear train, such as a star gear system (sun gear in meshing engagement with a plurality of star gears supported by a carrier and in meshing engagement with a ring gear) or other gear system. Geared architecture 48 can have a gear reduction ratio of greater than about 2.3 and low pressure turbine 46 can have a pressure ratio that is greater than about five (5). The bypass ratio of gas turbine engine 20 can be greater than about ten (10:1). The diameter of fan 42 can be significantly larger than that of the low pressure compressor section 44, and the low pressure turbine 46 can have a pressure ratio that is greater than about five (5:1). Low pressure turbine 46 pressure ratio is measured prior to inlet of low pressure turbine 46 as related to the pressure at the outlet of low pressure turbine 46 prior to an exhaust nozzle. It should be understood, however, that the above parameters are exemplary of particular embodiments of a suitable geared architecture engine and that the present disclosure contemplates other turbine engines including direct drive turbofans.

The next generation of turbofan engines are designed for higher efficiency and use higher pressure ratios and higher temperatures in high pressure compressor 52 than are conventionally experienced. These higher operating temperatures and pressure ratios create operating environments that cause thermal loads that are higher than the thermal loads conventionally experienced, which occasionally shortens the operational life of current components.

Figure 2:
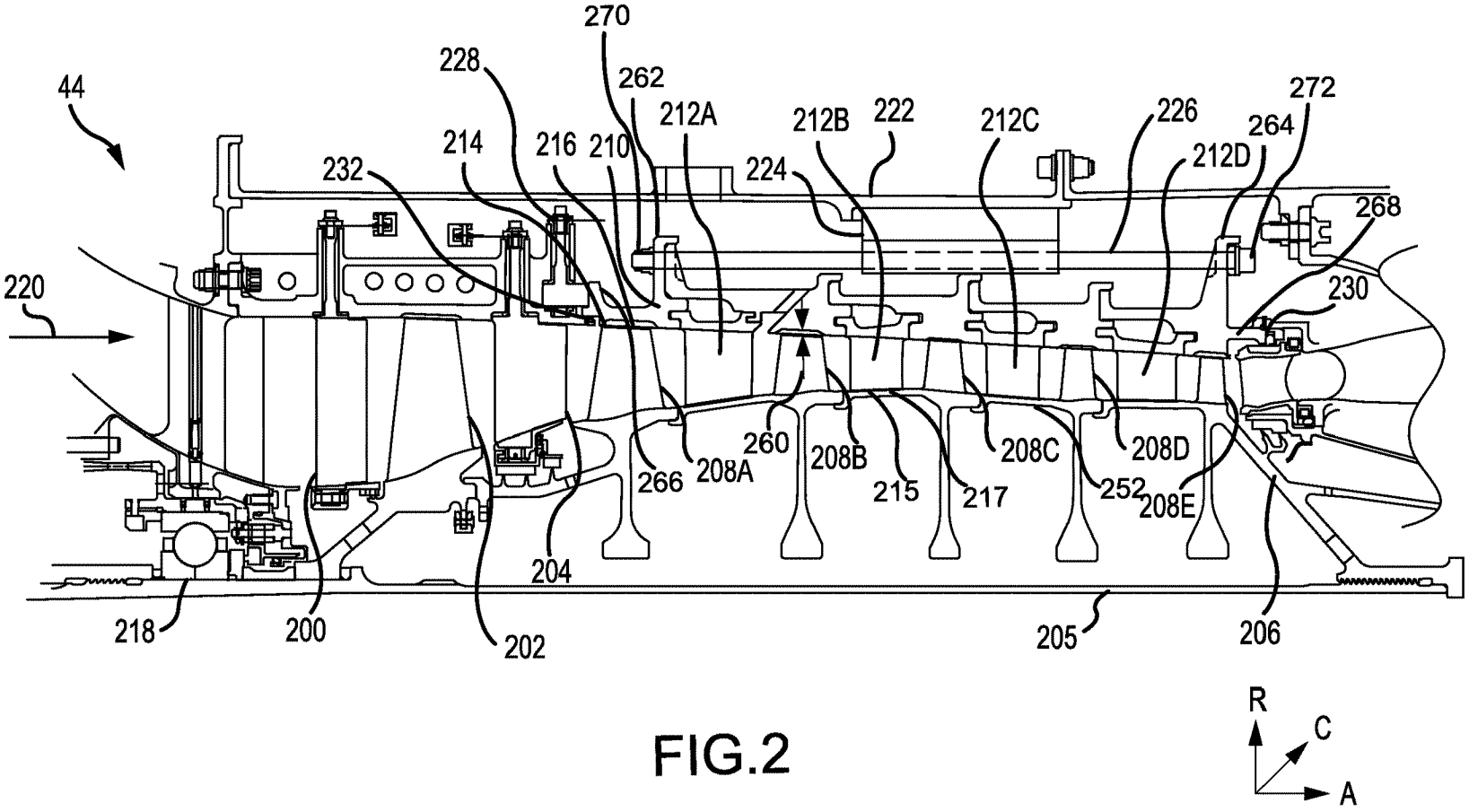
FIG. 2 illustrates a cross-sectional view of a low pressure compressor section of the gas turbine engine of FIG. 1, in accordance with various embodiments.

With reference now to FIG. 2, low pressure compressor section 44 includes a rotor assembly 206 and a stator assembly 210. Fluid flows aft into low pressure compressor section 44 as indicated by arrow 220 where it is initially conditioned by a guide vane 200. A rotor 202 coupled to rotor assembly 206 propels the fluid aft by rotating about the A axis. After being propelled by rotor 202, the fluid is again conditioned by a guide vane 204. Guide vane 200 and guide vane 204 are coupled to a case 222 and are stationary relative to the rotating rotor 202.

After conditioning by guide vane 204, the fluid is propelled aft (i.e., compressed) by a rotor 208A, conditioned by a stator 212A, propelled aft by a rotor 208B, conditioned by a stator 212B, propelled aft by a rotor 208C, conditioned by a stator 212C, propelled aft by a rotor 208D, conditioned by a stator 212D and propelled aft by a rotor 208D. In that regard, low pressure compressor section 44 includes five stages of rotors 208 separated by four stators 212. The rotors 208 rotate about the A axis while the stators 212 do not rotate about the A axis. Case 222 circumferentially surrounds each of the rotors and stators.

Stator assembly 210 has an outer diameter edge 216 from which the stators 212 extend radially inward to an inner diameter edge 217 defined by the radially inner edges of stators 212. Rotor assembly 206 includes an inner diameter edge 215 from which rotors 208 extend radially outward to an outer diameter edge 214 defined by the radially outer edges of rotors 208.

It is desirable for a distance 260 between outer diameter edge 216 of stator assembly 210 and outer diameter edge 214 of rotor assembly 206 to be small. As fluid is propelled aft, pressure builds between each stage of low pressure compressor section 44. As distance 260 increases, more air leaks forward between each stage. However, it is preferable for distance 260 to be greater than zero as it is desirable to include room for tolerances. As gas turbine engine 20 is in use and being maneuvered, loads, or forces, are applied to rotor assembly 206 that cause rotor assembly 206 to move in the radial direction. These loads include maneuver loads, the normal pulling of rotors 208 as it rotates due to non-centered weights, differential thermal growth between rotor assembly 206 and stator assembly 210 and the like. Accordingly, distance 260 is selected so that rotor assembly 206 and stator assembly 210 are unlikely to make contact during normal operating conditions.

A tie shaft 205 holds rotor 202 and rotors 208 together axially so they do not separate in the axial direction. A bearing 218 is coupled to case 222 and resists radial force of rotor assembly 206 to reduce the likelihood of rotor assembly 206 changing position radially relative to case 222. A ball bearing resists radial force of rotor assembly 206 to further reduce the likelihood of rotor assembly 206 changing position radially relative to case 222. The ball bearing allows rotor assembly 206 to expand in the aft direction due to thermal and pressure forces.

A forward end 266 of stator assembly 210 is coupled to an actuator 228. A forward sliding seal 232 allows stator assembly 210 to move forward and aft while forming a seal with case 222. Similarly, an aft end 268 of stator assembly 210 is coupled to case 222 via an aft sliding seal 230 that allows stator assembly 210 to move in the axial direction relative to case 222 while forming a seal with case 222. Actuator 228 can include any actuator capable of changing the position of stator assembly 210 relative to case 222 and, thus, rotor assembly 206. As illustrated, actuator 228 utilizes a roller cam actuation system. In another embodiment, an actuator is positioned at the aft end of stator assembly 210 instead of or in addition to actuator 228 positioned at the forward end of stator assembly 210.

As illustrated, outer diameter edge 216 of stator assembly 210 and inner diameter edge 217 of rotor assembly 206 form a conic shape such that the larger plane surface of the conic shape is forward and the radius of the conic shape decreases towards the vertex of the conic shape in the aft direction. Accordingly, by actuating stator assembly 210 in the forward direction, the radius of the conic shape is reduced, thus reducing distance 260 and increasing the efficiency of low pressure compressor section 44 by reducing the amount of fluid leaking between stages.

A forward flange 262 of stator assembly 210 is coupled to a forward end 270 of a linear guide rail 226 and an aft flange 264 of stator assembly 210 is coupled to an aft end 272 of linear guide rail 226. A carriage 224 is coupled to case 222 and slidably coupled to linear guide rail 226. Accordingly, linear guide rail 226 can move forward and aft relative to carriage 224 and thus case 222. Carriage 224 and linear guide rail 226 are designed such that linear guide rail 226 and carriage 224 resist radial motion relative to case 222. Stated another way, carriage 224 and linear guide rail 226 resist a radial force of stator assembly 210 and carriage 224 and linear guide rail 226 allows axial movement of stator assembly 210.

Figure 3:
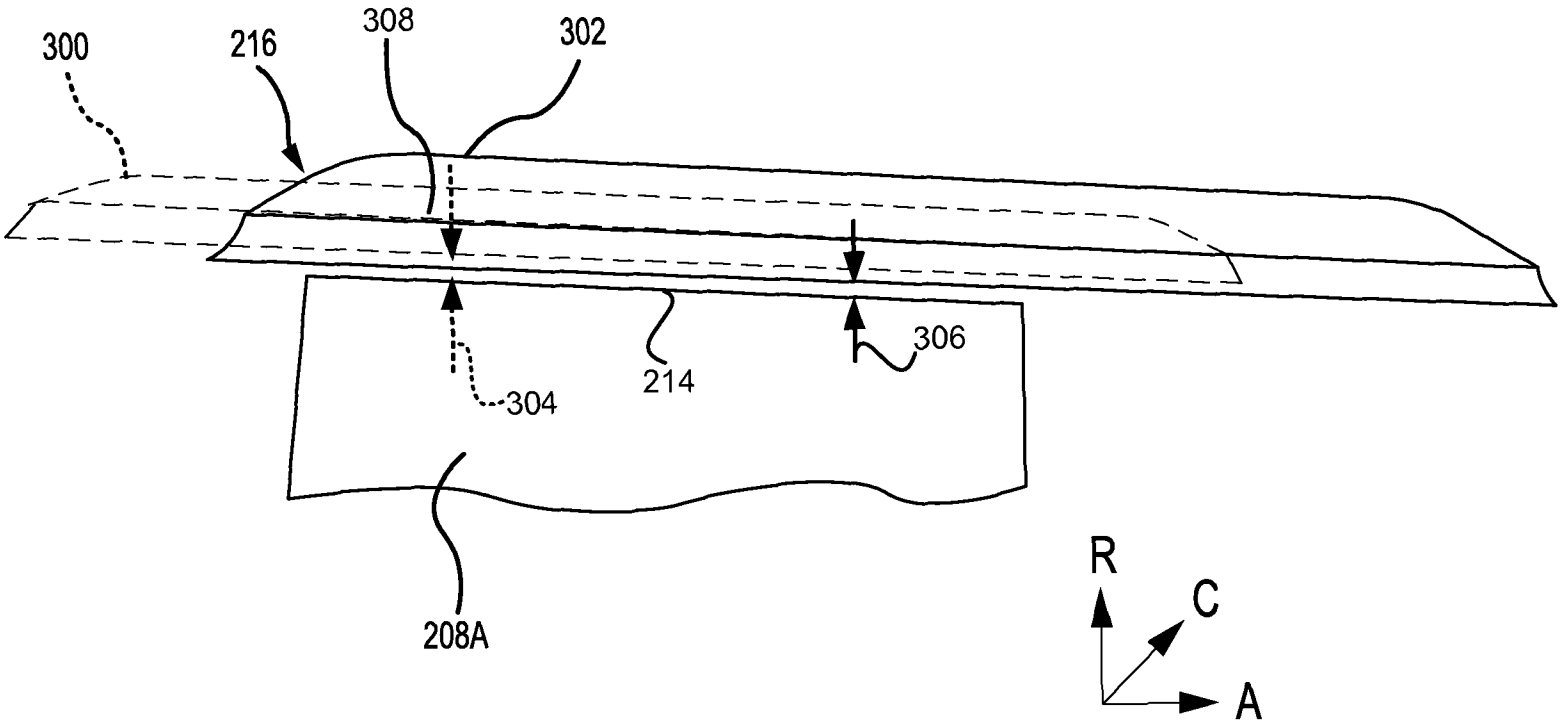
FIG. 3 illustrates a cross-sectional view of two axial positions of a stator assembly relative to an outer diameter edge of a rotor, in accordance with various embodiments.

With reference now to FIG. 3, a portion 308 of outer diameter edge 216 of stator assembly 210 is shown in a first position 302 and a second position 300 relative to rotor 208A. First position 302 of portion 308 is positioned aft of second position 300 of portion 308. When outer diameter edge 216 is in first position 302, a distance 306 exists between portion 308 and rotor 208A. As outer diameter edge 216 moves forward relative to rotor 208A to second position 300, a new distance 304 exists between portion 308 and rotor 208A. Because of the conic shape defined by stator assembly 210 and rotor assembly 206, distance 304 is smaller than distance 306.

The reduction in distance between first position 302 and second position 300 reduces an amount of fluid that leaks between rotor 208A and portion 308. Accordingly, when portion 308 is in second position 300, low pressure compressor section 44 is more efficient yet has less tolerance of axial movement of rotor 208A. Thus, second position 300 is desirable when less tolerance is desired between rotor 208A and portion 308. When portion 308 is in first position 302, low pressure compressor section is less efficient yet has more tolerance for axial movement of rotor 208A. Thus, first position 302 is desirable when more tolerance is desired between portion 308 and rotor 208A.

Figure 4:
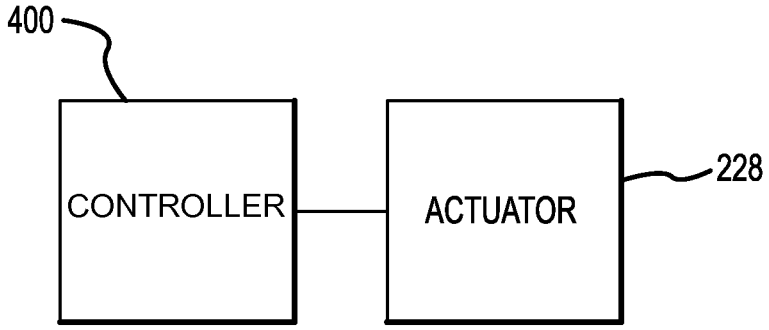
FIG. 4 illustrates a controller coupled to an actuator of the low pressure compressor section of FIG. 2, in accordance with various embodiments.

With reference to FIGS. 2 and 4, a controller 400 is be coupled to actuator 228. Controller 400 can include a processor and a tangible, non-transitory memory and be capable of implementing logic. The processor can be a general purpose processor, a digital signal processor (DSP), an application specific integrated circuit (ASIC), a field programmable gate array (FPGA) or other programmable logic device, discrete gate or transistor logic, discrete hardware components, or any combination thereof. The controller 400 can receive signals generated.

Controller 400 receives information regarding gas turbine engine 20, such as upcoming maneuvers, landings, takeoffs or the like; information regarding the environment, such as whether pockets of low pressure exist in the current environment; instructions from an operator of the aircraft; and/or information regarding conditions of the gas turbine engine such as rotational engine speed, temperature data, acceleration data received from accelerometers positioned in the engine, proximity of components received from proximity sensors or the like. Controller 400 determines if any loads or forces will be applied to rotor assembly 206 such as maneuver loads, thermal growth or the like based on the information. Based on the forces on rotor assembly 206, controller 400 instructs actuator 228 to cause stator assembly 210 to be in a suitable position relative to rotor assembly 206. When in a suitable position, low pressure compressor section 44 will function with a high efficiency while retaining a low likelihood of collision between outer diameter edge 214 of rotor assembly 206 and outer diameter edge 216 of stator assembly 210.

Figure 5:
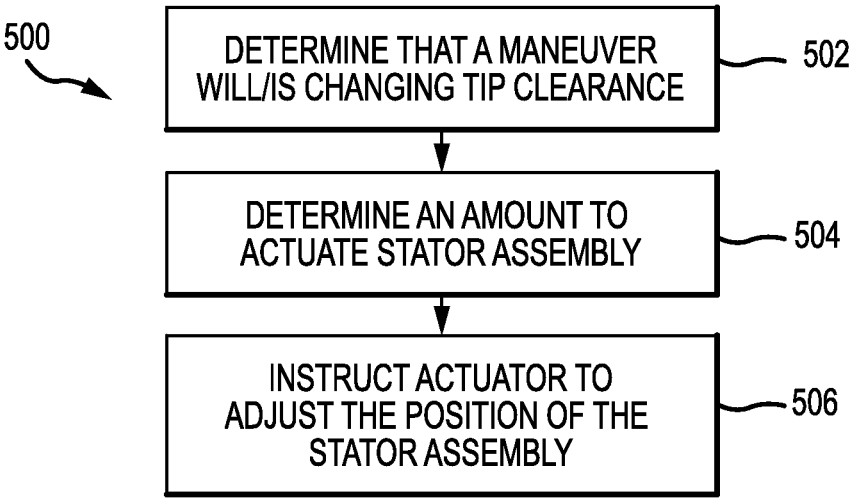
FIG. 5 illustrates flowchart corresponding to a method to be performed by the controller of FIG. 4, in accordance with various embodiments.

With reference to FIGS. 2, 4 and 5, a method 500 is performed by controller 400 for causing actuator 228 to position stator assembly 210 in a suitable position relative to rotor assembly 206. In block 502, controller 400 determines that a maneuver or event is currently or is likely to change the clearance between outer diameter edge 214 and outer diameter edge 216. Controller 400 can also or instead receive an instruction from an operator of the aircraft regarding a desired tolerance between rotor assembly 206 and stator assembly 210 and/or an indication from the operator of whether a tolerance and/or efficiency change is desired.

In block 504, when a maneuver or situation is currently or can change the clearance between rotor assembly 206 and stator assembly 210 (stated differently, when an input indicates that a force will be applied to the engine), controller 400 determines an amount to actuate stator assembly 210. As mentioned with reference to FIG. 4, the amount controller 400 will cause actuator 228 to actuate stator assembly 210 is an amount in which the tip clearance is sufficient to reduce the likelihood of contact between stator assembly 210 and rotor assembly 206 while providing maximum efficiency. Additionally or instead, controller 400 can receive an amount to actuate stator assembly 210 from an operator.

In block 506, controller 400 instructs actuator 228 to adjust the position of stator assembly 210 relative to rotor assembly 206 the amount determined in block 504. As discussed above, this places stator assembly 210 in an optimal position relative to rotor assembly 206 for tip clearance and efficiency of low pressure compressor section 44.

The concepts disclosed herein have been described with reference to a low pressure compressor section of a gas turbine engine. However, one skilled in the art will realize that these concepts are applicable to any system including a rotor assembly having a rotor that rotates relative to an axis and a stator assembly having a stator that does not rotate relative to the axis. Additionally, the concepts have been described with reference to a stator assembly moving axially relative to a rotor assembly. However, one skilled in the art will realize that these concepts are applicable to a system in which a rotor assembly moves relative to a stator assembly.

Benefits, other advantages, and solutions to problems have been described herein with regard to specific embodiments. The scope of the disclosure, however, is provided in the appended claims.

What is claimed is:

1. A system for increasing efficiency of a gas turbine engine comprising:

a stator assembly including a plurality of stator airfoils;

a rotor assembly including a plurality of rotor airfoils configured to rotate about an axis;

a distance actuator coupled to the stator assembly and configured to actuate the plurality of stator airfoils of the stator assembly in an axial direction relative to the rotor assembly, creating an axial movement such that a clearance between the at least one rotor airfoil from the plurality of rotor airfoils and the stator assembly varies based on an axial position of the stator assembly;

a case configured to remain stationary relative to rotation of the rotor assembly and the axial movement of the stator assembly;

a forward sliding seal coupled to a forward end of the stator assembly and configured to allow the axial movement of the stator assembly relative to the case while maintaining a seal between the stator assembly and the case;

an aft sliding seal coupled to an aft end of the stator assembly and configured to allow the axial movement of the stator assembly relative to the case while maintaining a second seal between the stator assembly and the case; and a linear guide rail coupled to the stator assembly and a carriage coupled to the case and slidably coupled to the linear guide rail such that the linear guide rail and the carriage allow the axial movement of the plurality of stator airfoils of the stator assembly and resist radial movement of the stator assembly.

2. The system of claim 1, wherein the efficiency of the system is increased by the distance actuator actuating the stator assembly axially from a second position to a first position, such that a distance between a stator outer diameter edge of the stator assembly and a rotor outer diameter edge of the rotor assembly is smaller in the first position than the second position.

3. The system of claim 1, wherein the efficiency of the system is increased by the distance actuator actuating the stator assembly aft relative to the rotor assembly.

4. The system of claim 1, further comprising a controller configured to control the distance actuator based on an input indicating a force to be applied to the system.

5. The system of claim 4, wherein the controller controls the distance actuator to actuate the stator assembly to a first position in response to the input indicating that a first amount of force will be applied to the system and to actuate the stator assembly to a second position being less efficient than the first position in response to the input indicating that a second amount of force greater than the first amount of force will be applied to the system.

6. The system of claim 1, wherein the system is implemented in a compressor section of the gas turbine engine.

7. The system of claim 1 wherein the system is implemented in a turbine section of the gas turbine engine.

8. A system for increasing efficiency of a compressor section of a gas turbine engine, comprising:

a rotor assembly including a rotor outer diameter edge, and a plurality of rotor airfoils configured to rotate about an axis and to compress a fluid;

a stator assembly including a stator outer diameter edge, and a plurality of stator airfoils configured to condition the fluid, such that the rotor outer diameter edge and the stator outer diameter edge define a conic shape;

an actuator coupled to the stator assembly and configured to actuate the plurality of stator airfoils of the stator assembly in an axial direction relative to the rotor assembly, creating an axial movement such that a clearance between the plurality of rotor airfoils and the stator assembly varies based on an axial position of the stator assembly;

a forward sliding seal coupled to a forward end of the stator assembly and configured to allow the axial movement of the stator assembly relative to a case while maintaining a seal between the stator assembly and the case; and a linear guide rail coupled to the stator assembly and a carriage coupled to the case and slidably coupled to the linear guide rail such that the linear guide rail and the carriage allow the axial movement of the plurality of stator airfoils of the stator assembly and resist radial movement of the stator assembly.

9. The system of claim 8, wherein the efficiency of the system is increased by the actuator actuating the stator assembly axially from a second position to a first position, such that a distance between the stator outer diameter edge and the rotor outer diameter edge is smaller in the first position than the second position.

10. The system of claim 8, further comprising a controller configured to control the actuator based on an input indicating a force to be applied to the system, wherein the controller comprises a processor, wherein the processor controls the actuator to actuate the stator assembly to a first position in response to the input indicating that a first amount of force will be applied to the system and to actuate the stator assembly to a second position being less efficient than the first position in response to the input indicating that a second amount of force greater than the first amount of force will be applied to the system.

11. A method for increasing efficiency of a compressor, the method comprising:

receiving, by a controller, an input indicating an amount of force to be applied to the compressor;

determining, by the controller, a determined direction and a determined amount to move a stator assembly in an axial direction relative to a rotor assembly based on the input, the stator assembly comprising a plurality of stator airfoils and the rotor assembly comprising a plurality of rotor airfoils, the stator assembly being coupled to a linear guide rail, the linear guide rail being slidably coupled to a carriage, and the carriage being coupled to a case; and instructing, by the controller, an actuator coupled to the stator assembly to actuate the plurality of stator airfoils of the stator assembly the determined amount in the determined direction, wherein the stator assembly and the rotor assembly maintain a seal during the stator assembly movement in the axial direction relative to the rotor assembly, and wherein the linear guide rail and the carriage allow the stator assembly to actuate the determined amount in the determined direction and resist radial movement of the stator assembly.

12. The method of claim 11, wherein the controller determines to actuate the stator assembly aft in response to the input indicating that a first amount of force will be applied to the compressor and determines to actuate the stator assembly forward in response to the input indicating that a second amount of force greater than the first amount of force will be applied to the compressor.

13. The method of claim 11, wherein the compressor is a low pressure compressor.

14. The method of claim 11, wherein the input includes at least one of an upcoming maneuver, an upcoming landing, an upcoming takeoff or an instruction received from an operator.

* * * * *